US009309625B2

(12) United States Patent
Backstrom et al.

(10) Patent No.: US 9,309,625 B2
(45) Date of Patent: Apr. 12, 2016

(54) CONCEPT TO SEPARATE WET END AND DRY END PAPER MACHINE CONTROL THROUGH ESTIMATION OF PHYSICAL PROPERTIES AT THE WIRE

(71) Applicants: Johan Backstrom, North Vancouver (CA); Michael Forbes, North Vancouver (CA)

(72) Inventors: Johan Backstrom, North Vancouver (CA); Michael Forbes, North Vancouver (CA)

(73) Assignee: Honeywell ASCa Inc., Mississauga (CA)

( * ) Notice: Subject to any disclaimer, the term of this patent is extended or adjusted under 35 U.S.C. 154(b) by 603 days.

(21) Appl. No.: 13/655,193

(22) Filed: Oct. 18, 2012

(65) Prior Publication Data

US 2014/0110871 A1 Apr. 24, 2014

(51) Int. Cl.
*D21G 9/00* (2006.01)

(52) U.S. Cl.
CPC ..... *D21G 9/0009* (2013.01)

(58) Field of Classification Search
USPC ..... 264/40.1
See application file for complete search history.

(56) References Cited

U.S. PATENT DOCUMENTS

| | | | |
|---|---|---|---|
| 5,853,543 | A | 12/1998 | Hu |
| 5,944,955 | A | 8/1999 | Bossen |
| 6,072,309 | A | 6/2000 | Watson |
| 6,080,278 | A | 6/2000 | Heaven |
| 6,284,100 | B1 | 9/2001 | Shakespeare et al. |
| 6,807,510 | B1 | 10/2004 | Backstrom |
| 7,496,413 | B2 | 2/2009 | Fan |
| 7,513,975 | B2 | 4/2009 | Burma |
| 7,566,382 | B2 | 7/2009 | Hietaniemi |
| 7,608,169 | B2 | 10/2009 | Backstrom |
| 7,609,366 | B2 | 10/2009 | Mac Hattie et al. |
| 7,846,299 | B2 | 12/2010 | Backstrom et al. |
| 8,101,047 | B2 | 1/2012 | Kulma |
| 8,224,476 | B2 | 7/2012 | Chu et al. |
| 2005/0082027 | A1 | 4/2005 | Virtanen et al. |
| 2011/0290438 | A1 | 12/2011 | Chu |
| 2011/0295390 | A1 | 12/2011 | Chu et al. |

OTHER PUBLICATIONS

Search report and written opinion for PCT/CA13/000837, mailed Jan. 8, 2014.

*Primary Examiner* — Jacob Thomas Minskey
(74) *Attorney, Agent, or Firm* — Charles H. Jew

(57) ABSTRACT

Partitioning control of the wet end and dry end, by introducing estimates of physical properties such as dry weight: and percent ash at the wire, allows for machine direction (MD) controls to continue during loss of scanner measurements. A mathematical model estimates the controlled, variables, such as dry weight, basis weight, and ash percent at the wire, and these estimated values are then controlled. When scanner measurements resume, parameters in the model are recursively updated to compensate for any model errors and ensure an accurate model. MD controls consist of a cascade set-up where the estimated wire-dry weight or wire basis weight and estimated wire ash percent are controlled by manipulating stock flow and addition of filler to stock. When scanner measurements are available, they become the downstream variables in the cascade control and are controlled by manipulation of the setpoints for the estimated wire weight and ash.

16 Claims, 4 Drawing Sheets

CONCEPT TO SEPARATE WET END AND DRY END PAPER MACHINE CONTROL THROUGH ESTIMATION OF PHYSICAL PROPERTIES AT THE WIRE

FIELD OF THE INVENTION

The present invention generally relates to techniques for monitoring and controlling continuous sheetmaking systems such as a papermaking machine and more specifically to separating the control of the wet end and dry end of the paper machine through estimation of one or more physical properties of the sheet that is formed at the wire. This technique affords papermaking machine direction controls to continue in the event of a sheet break or other disturbance that results in the loss of scanner measurements at the dry end.

BACKGROUND OF THE INVENTION

Various systems are available and used to manufacture sheets of paper and other paper products. The sheets of paper being manufactured often have multiple properties that are monitored and controlled during the manufacturing process. With the standard approach to papermaking machine direction (MD) controls, controlled variables, such as basis weight or dry weight of the paper and the ash content of the paper, are measured at the reel and controlled by adjustment of manipulated variables, such as stock flow to the machine and filler addition to the stock. The control of these or other sheet properties in a sheet-making machine is typically concerned with keeping the sheet properties as close as possible to target or desired values.

In the manufacturing process, if there is a sheet break that prevents the paper sheet from reaching the reel scanner, or if the reel scanner malfunctions, the controller loses measurements and the MD controls can no longer be used. During the interim when measurements are not available and the MD controls are off, process changes may occur that move the controlled variables away from, their desired operating points. Subsequently when the sheet is re-threaded, through the papermaking machine and is put back on the reel and/or scanner measurements resume, production is interrupted. While the controller brings these variables back, to target for a period of time after the rethreading, the paper sheet produced may not be usable or saleable. This is because the break in the paper sheet often disturbs or interferes with the control of the sheet-making machine, so the paper sheet produced after the break typically has sheet properties that are not near the target or desired values. As a result, the sheet-making machine often, needs to be operated until the disturbances earned by the break are eliminated and the sheet properties return to or near the target or desired values. This results in a loss of both time and materials. What is needed is a means of keeping the controlled variables close to target even when they cannot be measured.

SUMMARY Of THE INVENTION

The present invention is based in part on the recognition that separating wet end and dry end paper machine control through estimation of one or more measurable physical variables for the paper that develops at the wire allows for paper machine MD controls to continue even when there is a sheet break or other loss of scanner measurements. A mathematical model is used to estimate the controlled variables, such as dry weight, basis weight, and ash percent at the wire, and these estimated values are then controlled, When scanner measurements are reestablished, parameters in the model are recursively updated to compensate for any model errors and to ensure an accurate model. MD controls preferably consist of a cascade set-up where the estimated wire dry weight or wire basis weight and estimated wire ash percent are controlled by manipulating the stock flow and the addition of filler to stock. When, the scanner measurements are available, they become the downstream variables in the cascade control and are controlled by manipulation of the setpoints for the estimated wire weight and ash. In a preferred application in papermaking, the dry weight and ash percent of the sheet that forms at the wire or web are estimated with a mathematical model The inventive technique can he implemented by estimating other measurable physical properties using different models. Other suitable physical properties include, for instance, brightness, opacity and formation characteristics such as floe size or fiber orientation.

Accordingly, in one aspect, the invention is directed to a control system for a sheet making machine, which has a wet end and a dry end. The wet end has a number of input variables that can be manipulated to affect the properties of the paper sheet being formed. The properties of the paper sheet at the wet end affect the properties of the sheet measured by sensors at the dry end.

The control system for the sheet making machine includes a dry end controller, an estimator and a wet end controller: The dry end controller is responsive to setpoints for the paper sheet properties at the dry end, the measurements of the paper sheet properties at the dry end and develops setpoints for the paper sheet properties at the wet end. Each setpoint establishes a target value for a respective paper sheet property at the wet end. The estimator is responsive to the measurements of the paper sheet properties at the dry end and to further signals which convey quantitative information of present values of the wet end input variables to develop estimated values of paper sheet properties at the wet end. The wet end controller is responsive to the setpoints for the wet end paper sheet properties developed by the dry end controller and to the estimated values of paper sheet properties at the wet end and manipulates the inputs to the wet end.

In another aspect, the invention is directed to a continuous control method for maintaining measurable properties of a sheet being formed in sheet making machine as close as possible to their setpoints as set forth above. The method including the steps of:

developing setpoints for the paper sheet properties at the wet end as a functions of the setpoints for the paper sheet properties at the dry end and the paper sheet properties measured by the sensors at the dry end, each of the setpoints for the paper sheet properties at the wet end quantitatively establishes a target for a respective one of the paper sheet properties at the wet end.

developing estimated values for wet end paper sheet properties as a function of the dry end paper sheet properties measured by the sensors and of further signals which convey quantitative information of present values of the wet end input variables; and manipulating the wet end input variables as a function of the setpoints and estimated values for the wet end properties.

With the present invention, in the case where the dry weight and ash. percent of the sheet that, develops at the wire or web are estimated, there is no loss of weight and ash control during sheet breakage. In particular, dry weight and ash percent can be controlled based on the wet end estimates while measured dry end values are unavailable. Furthermore, this reduces the likelihood of sheet breakage while threading the machine.

The measured values will be closer to target when the sheet is threaded, into the machine thereby reducing scrap and lost time.

Another feature of the invention is that separating the wet end and dry end control variables effectively increases the bandwidth for disturbance rejection since estimated values for dry weight and ash percent of the sheet at the wet end eliminate much of control delay associated with waiting for dry end measurements. Some wet end disturbances will be eliminated more quickly.

While the invention will be illustrated as implemented in papermaking, it is understood that the invention is applicable in other sheet making processes such as, for example, in the manufacturer of rubber sheets, plastic film, metal foil, and the like. For these applications, the "wet end" corresponds to the initial unit operations where the raw material in its molten or pliable state is processed and the "dry end" corresponds to a downstream phase where the final sheet product is formed.

DETAILED DESCRIPTION OF PREFERRED EMBODIMENTS

Figure 1:
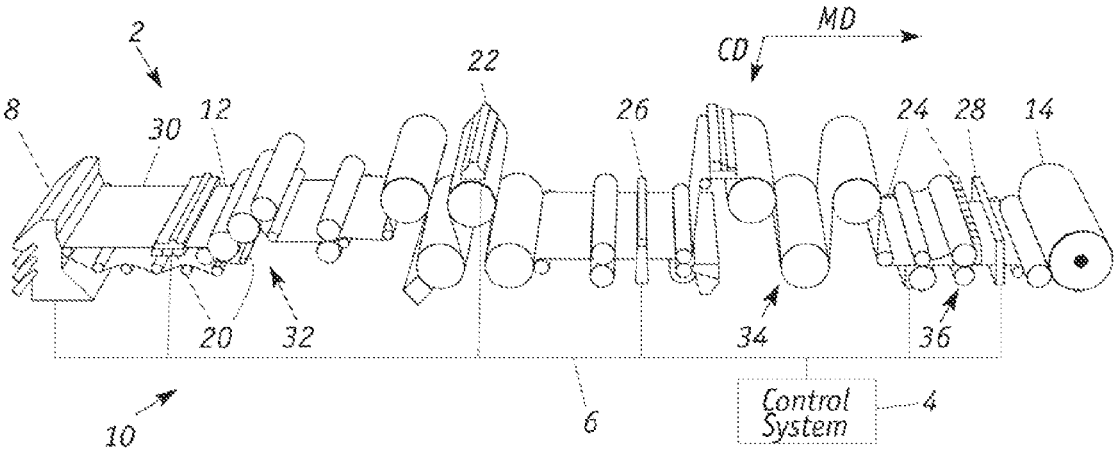
FIG. 1 is a schematic illustration of a papermaking system.

The process control, system will be illustrated by implementing the technique in a sheetmaking system 10 that includes papermaking machine 2, control system 4 and network 6 as illustrated in FIG. 1. The papermaking machine 2 produces a continuous sheet of paper material 12 that is collected in take-up reel 14. The paper material 12, having a specific width, is produced from a pulp suspension, comprising of an aqueous mixture of wood fibers and other materials, which undergoes various unit operations that are monitored and controlled by control system 4. The network 6 facilitates communication between the components of system 10.

The papermaking machine 2 includes a head box 8, which distributes a pulp suspension uniformly across the machine onto a continuous moving screen or wire 30, The pulp suspension entering headbox 8 may contain, for example, 0.2-3% wood fibers and possibly other solids, with the remainder of the suspension being water. Headbox 8 includes any suitable structure for distributing a pulp suspension. Headbox 8 may, for example, include a slice opening through which the pulp suspension is distributed onto screen or wire 30 which comprise a suitable structure such as a mesh for receiving a pulp suspension and allowing water or other materials to drain or leave the pulp suspension. As used herein, the "wet end" forming portion of sheetmaking system 10 comprises headbox 8 and wire 30 and those sections before the wire 30, and the "dry end" comprises the sections that are downstream from wire 30.

Sheet 12 then enters a press section 32, which includes multiple press rolls where sheet 12 travels through the openings (referred to as "nips") between pairs of counter-rotating rolls in press section 32, In this way, the rolls in press section 32 compress the pulp material forming sheet 12. This may help to remove more water from the pulp material and to equalize the characteristics of the sheet 12 on both of its sides.

As sheet 12 travels over a series of heated rolls in dryer section 34, more water in sheet 12 is evaporated. A calendar 36 processes and finishes sheet 12, for example, by smoothing and imparting a final finish, thickness, gloss, or other characteristic to sheet 12, Other materials (such as starch or wax) can also be added to sheet 12 to obtain the desired finish. An array of induction heating actuators 24 applies heat along the cross direction (CD) to one or more of the rollers to control the roll diameters and thereby the size of the nips. Once processing by calendar 36 is complete, sheet 12 is collected onto reel 14.

Sheetmaking system 10 further includes an array of steam actuators 20 that controls the amount of hot steam that is projected along the CD. The hot steam increases the paper surface temperature and allows for easier cross direction removal of water from the paper sheet. Also, to reduce or prevent over drying of the paper sheet, paper material 14 is sprayed with water in the CD. Similarly, an array of rewet shower actuators 22 controls the amount of water that is applied along the CD.

In order to control the papermaking process, the properties of sheet 12 are continuously measured and the papermaking machine 2 adjusted to ensure sheet quality. This control may be achieved by measuring sheet properties using one or more scanners 26, 28 that are capable of scanning sheet 12 and measuring one or more characteristics of sheet 12, For example, scanner 28 could carry sensors for measuring the dry weight, moisture content, ash content, or any other or additional characteristics of sheet 12. Scanner 28 includes suitable structures for measuring or detecting one or more characteristics of sheet 12. such as a set or array of sensors. A scanning set of sensors represents one particular embodiment for measuring sheet properties. An array of stationary sensors can be used instead. Scanner 28 is particularly suited for measuring the dry end dry weight and ash content of the paper product.

Measurements from scanner 28 are provided to control, system 4 that adjusts various operations of papermaking machine 2 that affect machine direction characteristics of sheet 12. A machine direction characteristic of sheet 12 generally refers to an average characteristic of sheet 12 that varies and is controlled in the machine direction. In this example, control system 4 is capable of controlling the dry weight of the paper sheet by adjusting the supply of pulp to the headbox 8. For example, control system 4 could provide information to a stock flow controller that regulates the flow of stock through valves and to headbox 8. Control system 4 includes any hardware, software, firmware, or combination thereof for controlling the operation of the sheetmaking machine 2 or other machine. Control system 4 could, for example, include a processor and memory storing instructions and data used, generated, and collected by the processor.

Figure 2:
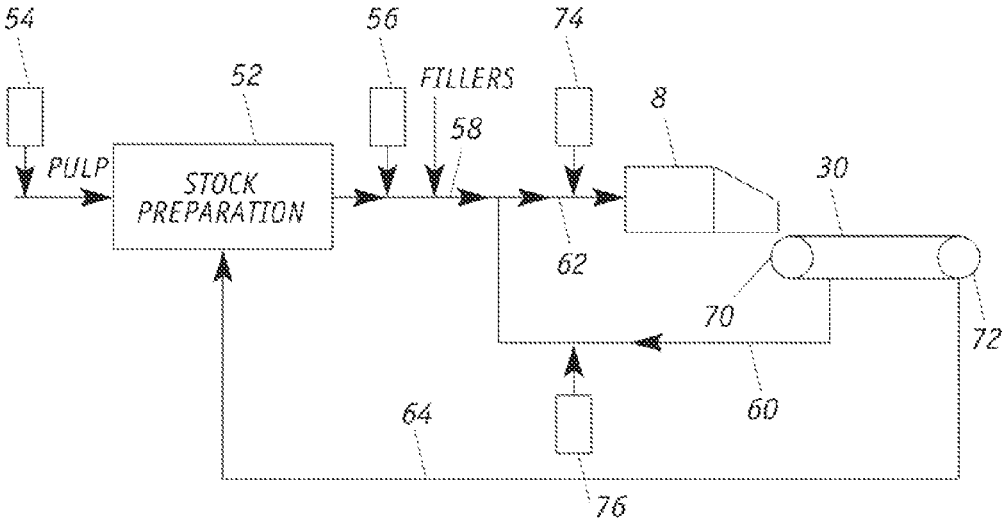
FIG. 2 is a schematic illustration of the wet end of a papermaking system.

The stock supplied to headbox 8 is produced in a process as shown in FIG. 2 where pulp is introduced into a stock preparation unit 52, For example, stock preparation unit 52 cleans and refines the pulp fibers so that the pulp fibers meet required standards. Stock preparation unit 52 could also receive and process recycled fibers recovered from the screen or wire 30 that rotates between rollers 70 and 72, The consistency of the pulp is measured with sensor 54 and signals therefrom can, be employed to control the flow of pulp and/or recycled water into stock preparation unit 52. Regulating the drive speed of rollers 70, 72 controls the wire or machine speed. Sensor 74 measures the total and ash consistency of the entering the headbox and sensor 76 measures the same properties of die white water. Readings from sensor 74, 76 are employed, for instance, in determining the values of, $c_{T_{ww}}$ the total consistency in the white water, $c_{T_{hb}}$ the total consistency in the headbox, $c_{a_{ww}}$ the ash consistency in the white water, $c_{a_{hb}}$ the ash consistency in the headbox, which are further explained here. The fibers in stock preparation unit 52 are mixed with one or more fillers. The resulting mixture represents a thick stock 58 and has a relatively high fiber consistency typically of about 4%. The thick stock 58 is then mixed with white water in a short circulation path 60 to produce a thin stock 62 that has a relatively low fiber consistency typically of about 0.2%. "White water" is the water that is removed from the wet stock on wire 30. The consistency of the stock exiting the stock preparation unit 52 is measured with sensor 56 and signals therefrom can be employed to control the flow of filler. The thin stock 62 is provided to headbox 8. A long circulation path 64 provides recycled material to stock preparation unit 52 for recovery.

Fillers including chemical additives can be added at different steps in the process. Wet-end chemical and. mineral additives include, for example, acids and bases, alum, sizing agents, dry-strength adhesives, wet-strength, resins, fillers, coloring materials, retention aids, such as polyacrylamides, fiber flocculants, defoamers, drainage aids, optical brighteners, pitch control chemicals, slimicides, and specialty chemicals. Precipitated calcium carbonate can be used as filler. Paper manufacturers use fillers to enhance printability, color and other physical characteristics of the paper.

The term "dry weight" refers to the weight of a material (excluding any weight due to water) per unit area. Paper is generally made of three constituents: wafer, wood pulp fiber, and ash. "Ash" is defined as that portion of the paper that remains after complete combustion. In particular, ash may include various mineral components such as calcium carbonate, titanium dioxide, and clay (a major component of clay is $SiO_2$). The term "water weight" refers to the mass or weight of water per unit area, of the wet paper stock that is on the wire. The term "basis weight" refers to the total weight of the material per unit area.

During normal operations of the papermaking machine 2 (FIG. 1), scanner measurements control operations of the papermaking machine with both the dry end control and wet end control loops operating. However, in the event of a paper breakage or other disturbance that causes the scanner measurements to be unavailable, the wet end control continues to operate.

In implementing the inventive process, once the physical properties to be estimated are selected, a mathematical model is developed to calculate their values.

For instance, the dry weight and percent wire ash can be estimated with the following formula:

$$\hat{d} = f_d \frac{r_T c_T \rho q}{vw} \text{ (dry weight estimate)}$$

$$r_T = 1 - \frac{c_{T_{ww}}}{c_{T_{hb}}}$$

$$\hat{a} = \frac{r_a c_a \rho q}{vw} \text{ (ash weight estimate)}$$

$$r_a = 1 - \frac{c_{a_{ww}}}{c_{a_{hb}}}$$

$$\%\,\hat{a} = f_a \times 100 \times \frac{\hat{a}}{\hat{d}} \text{ (ash percent estimate)}$$

where $\hat{d}$ is the estimated dry weight at the wire, $r_{96}$ is estimated total retention which is the proportion of solids retained on the wire, $c_{96}$ cris total consistency which is the mass of solids in the stocks as a percent of the total mass of the stock, ρ is stock density at the headbox, q is stock flow from the headbox to the wire, v is machine speed, w is sheet width; $\hat{a}$ is the estimated ash weight at the wire, $r_a$ is estimated ash retention on the wire, $C_a$ is ash consistency of the stock flow to the headbox, $c_{\tau_{ww}}$ is total consistency in the white water, $c_{\tau_{hb}}$ is total consistency in the headbox, $C_{a_{ww}}$ is ash consistency in the white water, $c_{\tau_{hb}}$ is ash consistency in the headbox, and $f_d$ is a correction factor based on the measured dry weight, d, which is derived by, for example, filtering of $$\frac{\hat{a}}{\hat{d}},$$

and, $f_a$ is a correction factor based on the measured ash, %α, which is derived by, for example, filtering of $$\frac{\%\,\hat{a}}{\%\,\hat{d}}.$$

Figure 3:
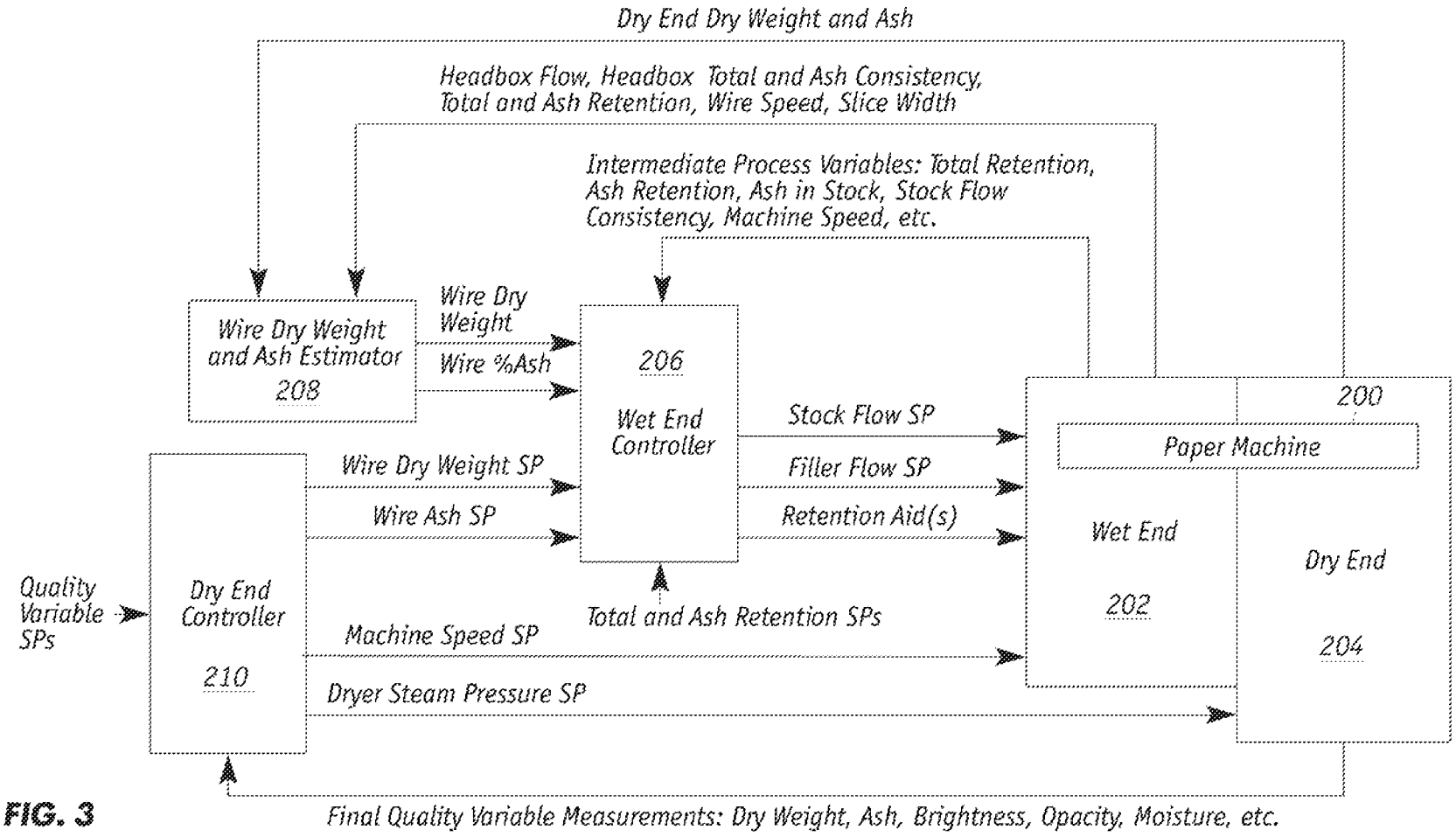
FIGS. 3 and 4 are block diagrams depicting the process control concept of maintaining paper machine control at the wet end through the use of a basis weight or dry weight estimator and a percent ash estimator.

With the control process of the present invention as illustrated in FIG. 3, control of the paper machine 200 is partitioned between the wet end 202 and dry end 204 by introducing estimates of the dry weight: and percent: ash at the wire 30 (FIG. 2). The process effects control of a set of final quality variables, such as, for example, dry weight, percent ash, moisture, brightness, opacify, and a set of wet end variables, such as, for example, estimated dry weight, estimated percent ash, total retention and ash retention. The clear partition of the wet end and dry end controls of the papermaking machine is easy for operators to understand and implement.

The control system includes a wet end controller 206, a wire dry weight aid ash estimator 208 and a dry end controller 210. As described above, scanners at the dry end 204 develop dry end signals that provide an electronic measure of the dry end dry weight (designated "Base Sheet DWT" in FIG. 4) and dry end ash weight ("Base Sheet Ash" in FIG. 4). The dry end signals are applied to the wire dry weight and ash estimator 208, which thus becomes cognizant of these parameters. Similarly, wet end signals are also developed at the wet end 202 which provide an electronic measure of the headbox flow, headbox total solids consistency, headbox ash consistency, total solids retention, ash retention, wire speed and slice width. The wet end signals are also applied to the wire dry weight (DWT) and ash estimator 208 which further becomes cognizant of these additional parameters.

Figure 4:
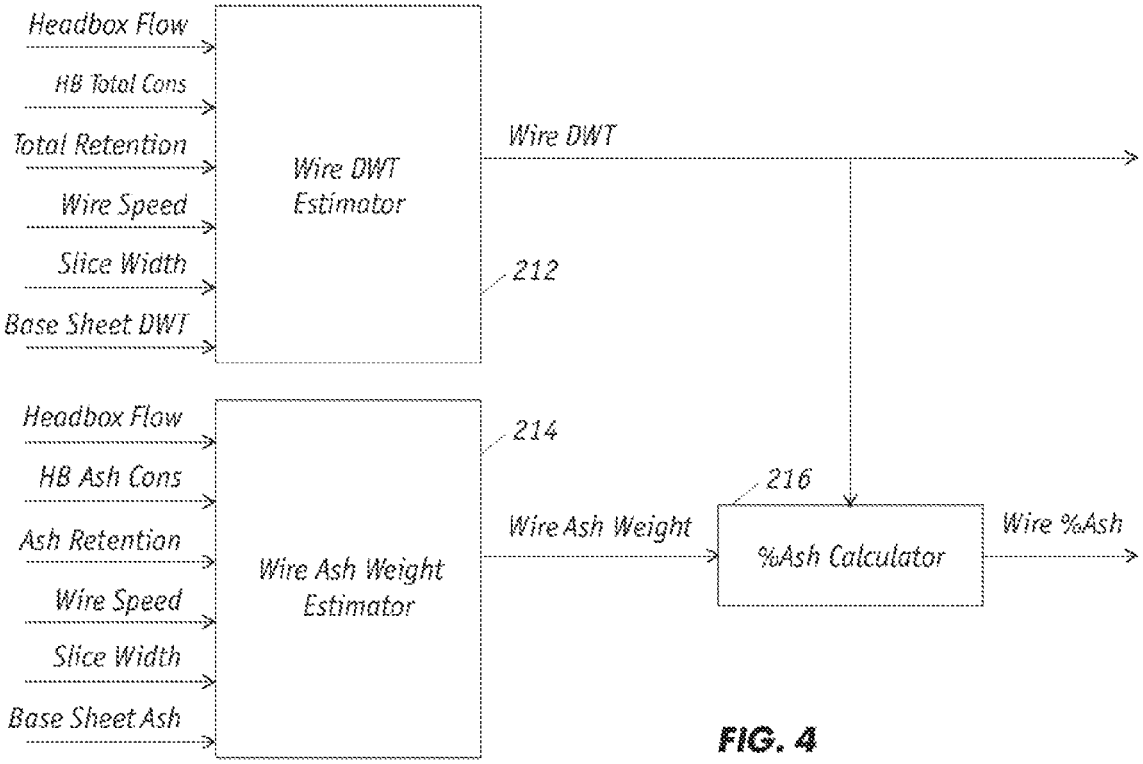

The estimator 208 calculates the wire dry weight and wire ash percentage which are supplied to wet end controller 206. More specifically, with further reference to FIG. 4, the estimator 208 includes a wire dry weight estimator 212, a wire ash weight estimator 214 and a percent ash calculator 216. As best seen in FIG. 4 a first subset of the above-described signals is applied to the wire dry weight estimator 212 to develop an estimated wire dry weight signal. Similarly, a. second subset of the above-described signals is applied to the wire ash weight estimator 212 to develop an estimated wire ash weight signal. Each of the estimated wire dry weight and the estimated wire ash weight signals is applied to the percent ash calculator 216 to develop an estimated percent ash signal. The estimated wire dry weight signal and the estimated percent ash signal developed by the estimator 208 are applied to the wet end controller 206, as best seen. in. FIG. 3

The dry end controller 210 is responsive to quality variable set points and further responsive to signals developed at the dry end that, provide a measure of final quality variable measurements such as, for example, dry weight, ash content, brightness, opacity and moisture. In response to these signals, the dry end controller 210 develops a machine speed set point. (SP) to the wet end process actuators and dryer steam pressure set point for application to the dry end process actuators, all such actuators being as described above. The dry end controller also in response to the signals applied thereto develops a wire dry weight, set point signal and a wire ash set point signal.

The wet end controller is responsive to the estimated wire dry weight and the estimated percent ash signals developed by the estimator 208 and further responsive to the wire dry weight set point and wire ash set point signals developed by the dry end controller 210. Total and ash retention set point signals are also applied to the wet end controller 206. In response to the applied signals, the wet end controller 206 develops a stock, flow set point signal, a filler flow set point signal and a retention aid(s) signal(s) for application to the above described wet end process actuators.

Figure 5:
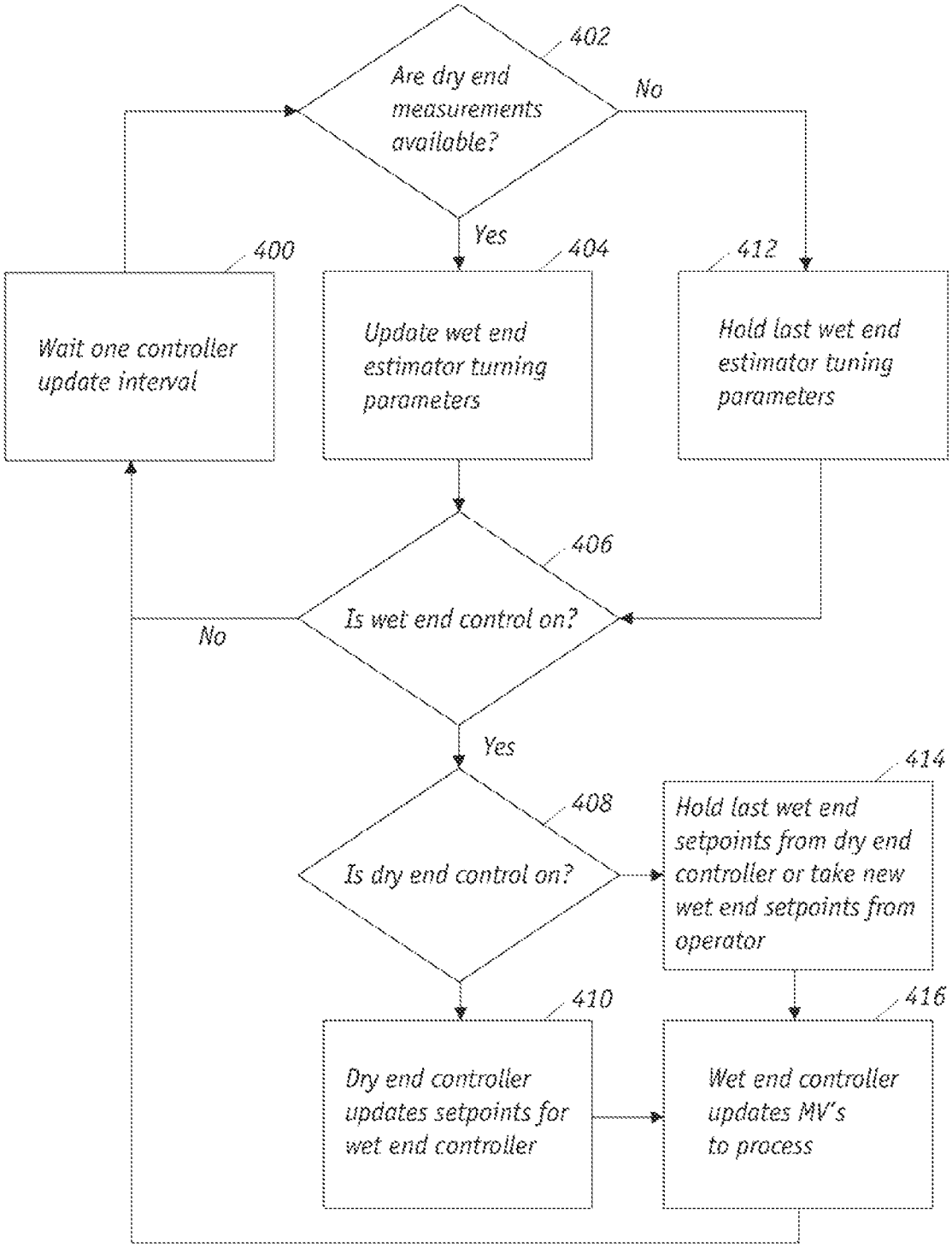
FIG. 5 is a flow diagram of a process implemented by the papermaking system.

With reference to FIG. 5, there is shown a flow diagram, of a process implemented by the apparatus described in conjunction with FIGS. 3-4. The process commences and reiterates with each controller update interval, as indicated at 400.

The first query, as indicated at 402, is whether dry end measurements are available. If yes, which is indicative of the dry end signals developed by the scanners being applied to the estimator 208, the estimated wire dry weight and the estimated percent ash signals developed by the estimator 208 are updated and these updated signals continued to be applied to the wet end controller 206, as indicated at 404.

The next query, as indicated at 406, is whether the wet end controls are on. If no, the process loops back to the update interval, indicated at 400. Otherwise, if yes, the third inquiry 408 is whether the dry end control is on. If yes, the dry end controller 210 updates the wire dry weight and wire ash setpoints for the wet end controller 206, as indicated at 410, Furthermore, as indicated at 416, the wet end controller 210 updates manipulated variables to process, prior to the process looping back to the update interval indicated at 400. If the response is no to the third inquiry 408, the last wet end setpoints from, the dry end controller 210 are held, as indicated at 414. Alternatively, new wet end setpoints may be entered from an operator of the paper machine 200. In either event, the process continues to the updating of the manipulated variables to process indicated at 416.

Returning to the first query indicated at 402, if the dry end measurements are not available, which is indicative of an interruption, failure or the like in the wet end 202, the present invention contemplates that the paper machine 200 may continue to operate by holding the last wet end estimator tuning parameters, as indicated at 412. In a specific embodiment of the present invention, the estimated wire dry weight and the estimated percent ash signals developed by the estimator 208 continue to be applied to the wet end controller 206.

The foregoing has described the principles, preferred embodiment and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A control system for a sheet making machine having a wet end that comprises a wire and a dry end, the wet end having manipulable elements which are adjusted to maintain properties of the sheet at the wet end, which properties effect measurable properties of the sheet that comprises paper at the dry end, and the dry end having sensors which develop electrical signals to convey quantitative information of the measurable properties, the control system comprising:

a dry end controller responsive to the measured values of properties of the sheet at the dry end developed by the sensors and operative to develop setpoint signals for properties of the sheet at the wet end, each of the setpoint signals quantitatively establishing a setpoint of a respective one of properties of the sheet at the wet end;

a wet end controller responsive to the setpoint signals for the wet end properties and operative to manipulate the wet end elements commensurately with the setpoints; and an estimator responsive to the measurements developed by the sensors and to further signals which convey quantitative information of present values of the inputs to the wet end to develop estimated values of wet end properties at the wire and said estimator includes a wire dry weight estimator, a wire ash weight estimator and a percent ash calculator, said estimated wet end property signals being commensurate with an estimated dry weight and an estimated percent wire ash relating to the corresponding measurable properties of dry weight and ash percentage at the dry end;

wherein in the event the setpoint signals are not currently available to establish the wet end setpoints the wet end controller being further responsive to the estimates of the wet end properties and operative to manipulate the wet end elements.

2. A control system as set forth in claim 1 wherein the estimated dry weight and an estimated percent wire ash are calculated in accordance with the formula:

$$\hat{d} = f_d \frac{r_T c_T \rho q}{vw} \text{ (dry weight estimate)}$$

$$r_T = 1 - \frac{c_{T_{ww}}}{c_{T_{hb}}}$$

$$\hat{a} = \frac{r_a c_a \rho q}{vw} \text{ (ash weight estimate)}$$

$$r_a = 1 - \frac{c_{a_{ww}}}{c_{a_{hb}}}$$

$$\%\ \hat{a} = f_a \times 100 \times \frac{\hat{a}}{\hat{d}} \text{ (ash percent estimate)}$$

where $\hat{d}$ is the estimated dry weight at the wire, $r_T$ is estimated total retention which is the proportion of solids retained on the wire, $c_T$ is total consistency which is the mass of solids in the stocks as a percent of the total mass of the stock, p is stock density at the headbox, q is stock flow from the headbox to the wire, v is machine speed, w is sheet width; $\hat{a}$ is the estimated ash weight at the wire, $r_a$ is estimated ash retention on the wire, $c_a$ is ash consistency of the stock flow to the headbox, $c_{T_{WW}}$ is total consistency in the white water, $c_{T_{hb}}$ is total consistency in the headbox, $c_{a_{WW}}$ is ash consistency in the white water, $c_{a_{hb}}$ is ash consistency in the headbox, and $f_d$ is a correction factor based on the measured dry weight, and $f_a$ is a correction factor based on the measured ash.

3. A control system as set forth in claim 2 wherein $f_d$ is derived by filtering of $$\frac{\hat{a}}{\hat{d}},$$

where d is the measured dry weight, and $f_a$ is derived by filtering of $$\frac{\%\,\hat{a}}{\%\,\hat{d}},$$

where %α is the measured percent ash.

4. A control system as set forth in claim 1 wherein the further signals commensurate with present values of the wet end variables include any of headbox flow, headbox total and ash consistency, total and ash retention, wire speed and slice width.

5. A control system as set forth in claim 1 wherein each of the setpoint signals developed by the dry end controller is commensurate with a setpoint of wire dry weight and wire ash, required by the wet end controller.

6. A control system as set forth in claim 5 wherein the dry end controller is further operative to develop setpoint signals the machine speed and dryer steam pressure.

7. A control system as set forth in claim 1 wherein the wet end controller manipulates any of stock flow, filler flow and retention aid flow.

8. A control system as set forth in claim 1 wherein the dry end controller is further responsive to quality variable setpoint signals relating to the measured properties of the sheet.

9. A continuous control method for maintaining measurable properties close to setpoints for the measurable properties of a sheet of paper being formed in a sheet making machine which has a wet end that comprises a wire and a dry end, the wet end having manipulable inputs which are adjusted to affect properties of the sheet at the wet end affecting measurable properties of the sheet being formed at the dry end and the dry end having sensors which develop measurements of the properties of the sheet at the dry end, the method comprising steps of:

developing setpoint signals for the properties of the sheet at the wet end as a function of the setpoints of the measurements developed by the sensors;

manipulating the wet end inputs as a function of the setpoints signals;

developing estimates of properties of the sheet at the wet end at the wire relating to the measured properties at the dry end as a function of the measurements developed by the sensors and to further signals which convey quantitative information of present values of the inputs to the wet end wherein the estimated values of the wet end properties are commensurate with an estimated dry weight and an estimated percent wire ash relating to the corresponding measurements of dry weight and ash percentage at the dry end; and in the event the setpoint signals are not currently available to establish wet end setpoints manipulating the wet end inputs as a function of the estimates for the properties of the sheet at the wet end.

10. A continuous control method as set forth in claim 9 wherein the further signals commensurate with present values of the wet end variables include any of headbox flow, headbox total and ash consistency, total and ash retention, wire speed and slice width.

11. A continuous control method as set forth in claim 9 wherein each of the setpoints for a property of the sheet at the wet end is commensurate with a setpoint of wire dry weight and wire ash.

12. A continuous control method as set forth in claim 11 further comprising developing additional setpoints for machine speed and dryer steam pressure.

13. A continuous control method as set forth in claim 9 wherein the wet end controller adjusts any of stock flow, filler flow and retention aid setpoints.

14. A continuous control method as set forth in claim 9 further comprising the step of calculating the estimated dry weight and an estimated percent wire ash in accordance with the formula:

$$\hat{d} = f_d \frac{r_T c_T \rho q}{vw} \text{ (dry weight estimate)}$$

$$r_T = 1 - \frac{c_{T_{ww}}}{c_{T_{hb}}}$$

$$\hat{a} = \frac{r_a c_a \rho q}{vw} \text{ (ash weight estimate)}$$

$$r_a = 1 - \frac{c_{a_{ww}}}{c_{a_{hb}}}$$

$$\%\,\hat{a} = f_a \times 100 \times \frac{\hat{a}}{\hat{d}} \text{ (ash percent estimate)}$$

where $\hat{d}$ is the estimated dry weight at the wire, $r_T$ is estimated total retention which is the proportion of solids retained on the wire, $C_T$ is total consistency which is the mass of solids in the stocks as a percent of the total mass of the stock, p is stock density at the headbox, q is stock flow from the headbox to the wire, v is machine speed, w is sheet width; $\hat{a}$ is the estimated ash weight at the wire, $r_a$ is estimated ash retention on the wire, $c_a$ is ash consistency of the stock flow to the headbox, $c_{T_{WW}}$ is total consistency in the white water, $c_{T_{hb}}$ is total consistency in the headbox, $c_{a_{WW}}$ is ash consistency in the white water, $c_{a_{hb}}$ is ash consistency in the headbox, and $f_d$ is a correction factor based on the measured dry weight and $f_a$ is a correction factor based on the measured ash.

15. A continuous control method as set forth in claim 14 wherein $f_d$ is derived by filtering of $$\frac{\hat{a}}{\hat{d}},$$

where d is the measured dry weight, and $f_a$ is derived by filtering of $$\frac{\%\,\hat{a}}{\%\,\hat{d}},$$

where %α is the measured percent ash.

16. A continuous control method as set forth in claim 14 wherein the setpoints for the properties of the sheet at the wet end are a further function of the setpoints for the measured values of the sheet at the dry end.

* * * * *